4/7/87 XR 4,671,498

United States Patent [19]

Uram

[11] Patent Number: 4,671,498

[45] **Date of Patent: * Jun. 9, 1987**

[54] MOLTEN METALS FILTER APPARATUS

[75] Inventor: Stuart Z. Uram, Alpine, N.J.

[73] Assignee: Certech Incorporated, Wood-Ridge, N.J.

[ * ] Notice: The portion of the term of this patent subsequent to Mar. 18, 2003 has been disclaimed.

[21] Appl. No.: 721,291

[22] Filed: Apr. 9, 1985

Related U.S. Application Data

[63] Continuation-in-part of Ser. No. 435,980, Oct. 22, 1982.

[51] Int. Cl.[4] ..... C21B 3/04; C21B 7/14

[52] U.S. Cl. ..... 266/227; 75/63; 164/227; 266/220

[58] Field of Search ..... 75/63; 266/229, 227, 266/220; 164/227

[56] References Cited

U.S. PATENT DOCUMENTS

| | | | |
|---|---|---|---|
| 2,620,269 | 12/1952 | Haney | 75/63 |
| 3,393,998 | 7/1968 | Lambert | 75/63 |
| 3,615,086 | 10/1971 | Jepson | 266/220 |
| 3,779,389 | 12/1973 | Fant | 266/227 |
| 3,843,355 | 10/1974 | Reding | 266/229 |

*Primary Examiner*—Peter D. Rosenberg

*Attorney, Agent, or Firm*—Amster, Rothstein & Ebenstein

[57] ABSTRACT

A molten metals filter apparatus having a hollow strainer, including an inlet port and a plurality of slot apertures having a uniform width for selectively restraining particulant impurities in molten metals.

21 Claims, 12 Drawing Figures

FIG. 4
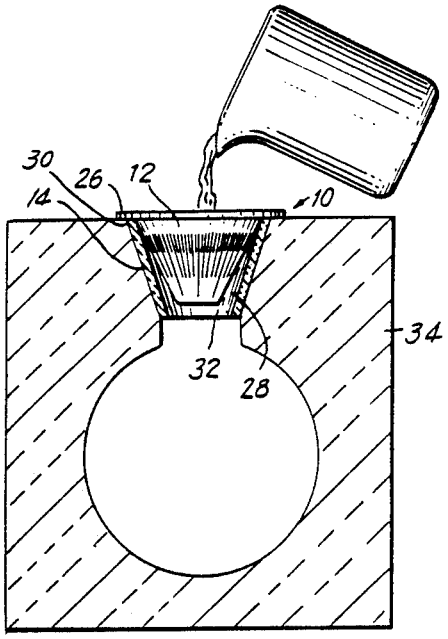
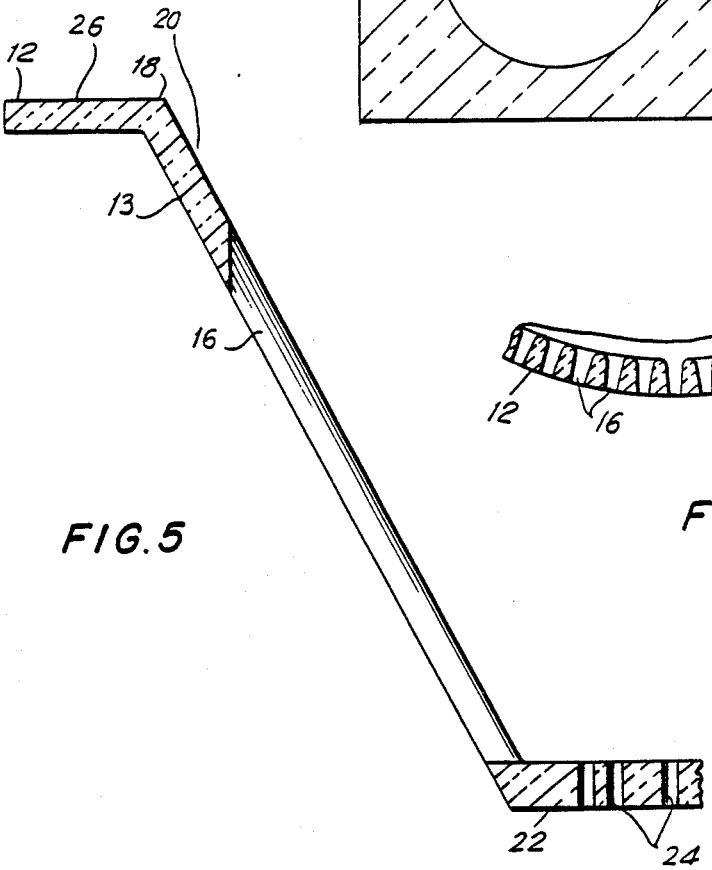
FIG. 5
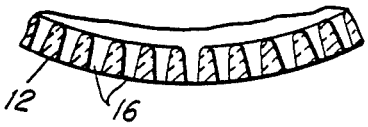
FIG. 6

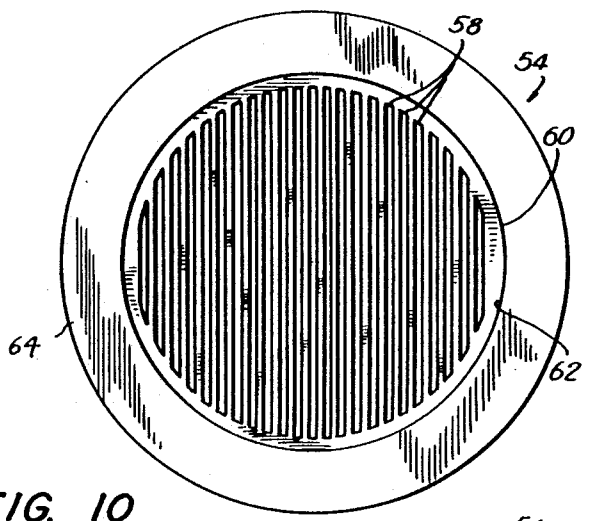
FIG. 9
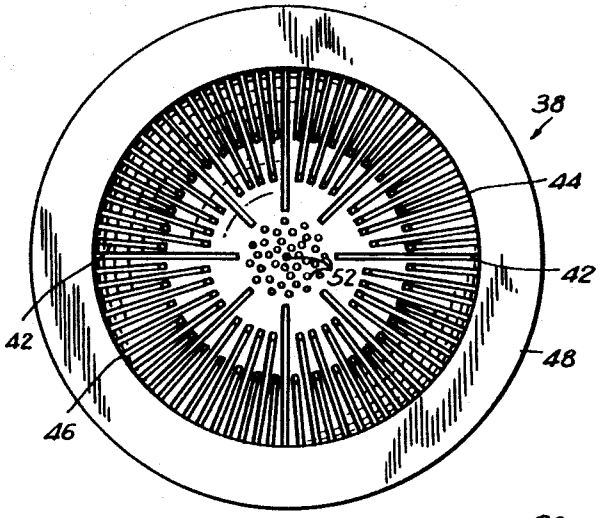
FIG. 7
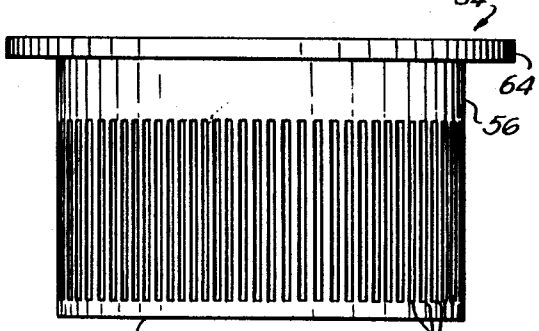
FIG. 10
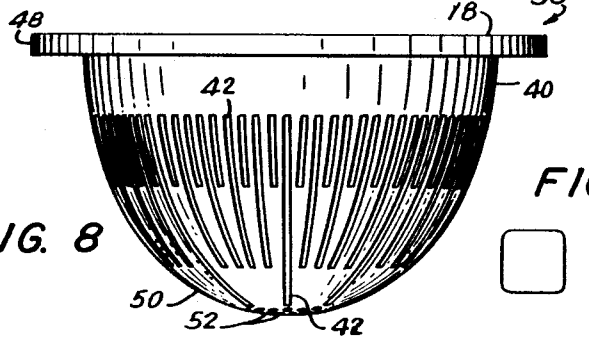
FIG. 8
FIG. 11
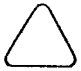
FIG. 12

MOLTEN METALS FILTER APPARATUS

This application is a continuation-in-part of application Ser. No. 435,980 filed Oct. 22, 1982.

BACKGROUND OF THE INVENTION

This invention relates to an apparatus for filtration of molten metals, and in particular, to such an apparatus adapted for filtration of molten metals as they are poured into a mold. More specifically, this invention relates to a hollow strainer having a plurality of slot apertures of uniform width for separating particulant impurities from the molten metal. The strainer may rest within a pour cup having an outlet port which mates with the inlet port of a mold. The slot apertures are disposed longitudinally about the surface of the strainer which may be formed with a larger diameter portion and a smaller diameter portion in which case the slot apertures are of staggered lengths so that there are relatively fewer slots extending to the smaller diameter portion of the strainer than extending to the larger diameter portion of the strainer. The bottom of the strainer may be formed with a plurality of apertures of a size substantially equal to the width of the slot apertures. The top of the strainer is open and has a flange disposed about its perimeter which abuts the lip of the pour cup. The strainer and the pour cup are made of refractory or ceramic material of sufficient heat resistance and strength to withstand the heat and thermal shock of molten metal.

Filters for molten metal have long been known in the art, but their usefulness has been limited by their substantial restriction of metal flow rate, the difficulties encountered in their use and/or their tendency to introduce unwanted foreign material into the mold. Presently used filters generally consist of disk-like members which are cemented or grouted into the inlet port of the mold. Unless the cementing or grouting is done with extreme care, it is possible for the molten metal to bypass and flow around the filter element. Further, during insertion, the grout or cement material may enter the mold as fine particles which cannot be removed once the filter is in place. Accordingly, nonmetallic inclusions can be trapped inside the mold and contaminate the casting. Three types of disk-like filters are commonly used. The first, known as a strainer core, is made by pressing a plate of ceramics with a series of holes. Because of the limitation of the pressing process, it is usually not possible to obtain greater than a 50 percent open area of holes. This results in a large restriction of metal flow making a strainer core unsuitable for investment castings. The second type of filter is a ceramic foam having an open cell structure. As in the case of a strainer core, this type of filter cannot be used for investment casting, since the flow restriction is too great. The third type of filter has a screen-like appearance and is made by extruding ceramic. The open area can be as high as 70 percent, and accordingly, this type of filter has become popular in investment casting. However, because this product is flat and light, the limitations inherent in cementing or grouting the filter into the mold inlet port as described above preclude its full acceptance.

SUMMARY OF THE INVENTION

The present invention overcomes the limitations associated with prior art molten metal casting filters by providing an apparatus including a hollow strainer having a plurality of slot apertures of uniform width which either rests within a pour cup having an outlet port adapted to mate with an inlet port of a mold or rests directly within the inlet port of the mold. Since the strainer means, much like a funnel, rests either within a pour cup or directly within the inlet port of the mold, there is no necessity to cement or grout the strainer into the inlet port, and accordingly, there is no danger of cement or grout invading the mold or of molten metal bypassing the strainer. By providing a plurality of slot-shaped apertures and by the use of a shape having a high surface area, the strainer has a high open area and permits relatively free flow of the molten metal through the strainer.

Accordingly, it is an object of the present invention to provide an improved filter for molten metal which is adapted for use at the inlet port of a mold and which obviates one or more of the disadvantages of the prior art and produces improved results.

It is a further object of the present invention to provide a molten metal filter apparatus which may be utilized without the necessity of cementing or grouting the filter onto a mold.

It is a still further object of this invention to provide a molten metal filter apparatus having a high open area to permit the relatively uninhibited flow of molten metal through the filter.

It is yet a further object of the present invention to provide a molten metal filter apparatus which is suitable for use in investment casting.

In accordance with the present invention, there is provided a refractory or ceramic hollow strainer having an inlet port and a plurality of slot apertures of uniform width about its surface. The strainer may be used in association with a pour cup at the inlet port of a mold. The top end of the strainer is fully open and may have a flange disposed about its perimeter to aid in positioning the strainer. In a particular illustrative embodiment demonstrating the objects and features of the present invention, the strainer is formed with larger and smaller diameter portions and the slot apertures are disposed longitudinally and are of staggered lengths so that there are relatively fewer slots extending to the smaller diameter portion of the strainer than to the larger diameter portion of the strainer. In addition, the bottom or smaller end of the strainer has a plurality of apertures of a size substantially equal to the width of the slot apertures.

BRIEF DESCRIPTION OF THE DRAWINGS

The above objects, aspects and advantages of the invention, as well as others, will be apparent from the detailed description of the preferred embodiment of the invention considered in conjunction with the drawings, which should be considered in an illustrative and not in a limiting sense, as follows:

FIG. 4 is a side elevational view in partial section showing the pour cup in place on a mold while molten metal is being poured;

FIG. 5 is a cross section of the frusto-conical strainer taken on line 5—5 of FIG. 1;

FIG. 6 is a cross section of the frusto-conical strainer taken on line 6—6 of FIG. 2;

FIG. 7 is a top plan view of a hollow hemispherical strainer showing the slot apertures, inlet port, bottom apertures and flange;

FIG. 8 is a side elevational view of the hemispherical strainer of FIG. 7;

FIG. 9 is a top plan view of a hollow cylindrical strainer showing slot apertures formed on the bottom and side surfaces thereof;

FIG. 10 is a side elevational view of the cylindrical strainer of FIG. 9;

FIG. 11 is a schematic representation of an alternate shape for the strainer shown in FIG. 9; and FIG. 12 is a schematic representation of another alternate shape for the strainer shown in FIG. 9.

DETAILED DESCRIPTION OF THE PREFERRED EMBODIMENT OF THE INVENTION

Figure 1:
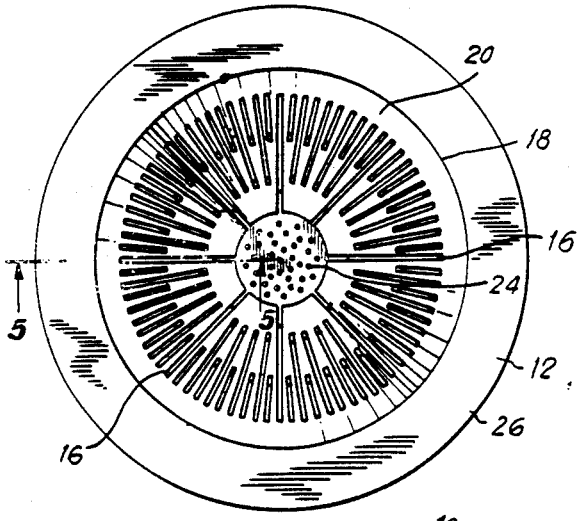
FIG. 1 is a top plan view of a hollow frusto-conical strainer showing the slot apertures, inlet port, bottom apertures and flange.
Figure 2:
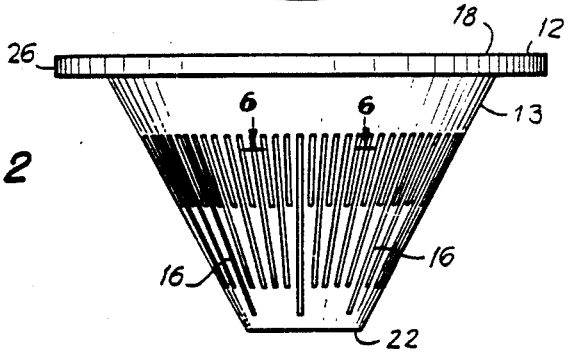
FIG. 2 is a side elevational view of the frusto-conical strainer of FIG. 1.
Figure 3:
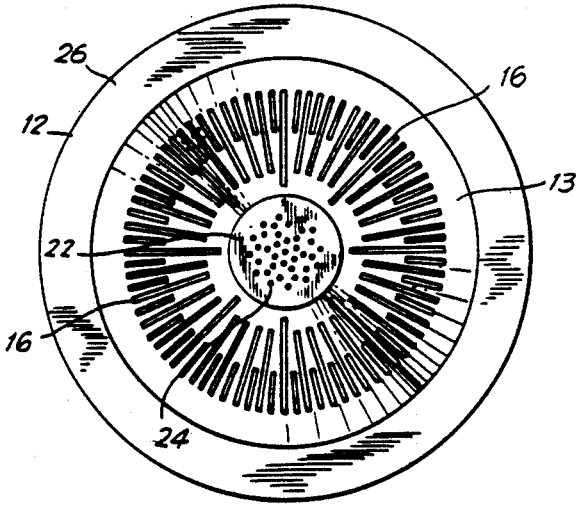
FIG. 3 is a bottom plan view of the frusto-conical strainer of FIG. 1.

Referring to FIGS. 1 and 2, a frusto-conical strainer 12 including a conical surface 13 having a plurality of slot apertures 16, an open top end 18 having an inlet port 20, a bottom end 22 having a plurality of apertures 24 and a flange 26 disposed about the perimeter of the top end 18 is shown.

The slot apertures 16 extend longitudinally about the conical surface 13 of the frusto-conical strainer 12 and are of staggered length so that there are relatively fewer slots which extend to the smaller diameter portion of the frusto-conical strainer 12 than which extend to the larger diameter portion of the frusto-conical strainer 12. By so staggering the slot apertures 16, a maximum number may be included in the conical surface 13 of the frustoconical strainer 12 while providing such slot apertures 16 with a uniform width. The bottom apertures 24 in the bottom end 22 have a size substantially equal to the uniform width of the slot apertures 16. The bottom apertures 24 are easily formed in circular configuration and may take other shapes as well, such as similar to the slot apertures 16. Although any suitable dimensions may be utilized, it is found that a dimension of approximately 0.05 inches is appropriate for straining most molten metals. Since, by far, the greatest portion of contaminant material in molten metal is generally spherical and not rod-like, use of slot openings rather than circular openings substantially increases the total flow area without materially decreasing the filtering effect of the device.

Referring to FIG. 4, it is seen that the frusto-conical strainer 12 may be used in association with a pour cup 14 so that the flange 26 of the frusto-conical strainer 12 abuts against the upper lip 30 of the pour cup 14. The pour cup 14 is dimensioned such that there is a chamber 28 between the conical surface 13 of the frusto-conical strainer 12 and the inner surface of the pour cup 14 through which metal may flow. The pour cup 14 has an outlet port 32 through which the strainer molten metal may exit.

As seen in FIG. 4, in use, a strainer and pour cup assembly 10 is seated upon a mold 34 having an inlet port 36, so that the outlet port 32 of the pour cup 12 engages the inlet port 36 of the mold 34. Molten metal is poured through the inlet port 20 of the frusto-conical strainer 12 and flows through the slot apertures 16 and circular apertures 24 into the chamber 28 of the pour cup 12 and out of the outlet port 32. Particulant impurities having dimensions larger than the width of the slot apertures 16 are restrained within the frusto-conical strainer 12.

The frusto-conical strainer 14 and pour cup 12 may be made of any material, particularly ceramic or refractory materials, having sufficient heat resitance and strength to withstand the heat and shock of poured molten metal. For example, the frusto-conical strainer 14 and pour cup 12 may be made of fused silica and zircon, alumina, alumina silicates, or zirconia. The frusto-conical strainer 12 is preferably manufactured by injection molding. Accordingly, as seen in FIG. 6, the slot aperture 16 may be tapered for ease of molding. Alternatively, the frusto-conical strainer may be manufactured by slip casting or pressing.

Referring now to FIGS. 7 and 8, in an alternate embodiment of the present invention, a strainer 38 is formed in a generally hemispherical shape. Specifically, the strainer 38 includes a hemispherical surface 40 having a plurality of slot apertures 42, an open top end 44 forming an inlet port 46 and a flange 48 disposed about the perimeter of the top end 44. The bottom portion or end 50 of the strainer 38 includes a plurality of apertures 52.

The slot apertures 42 extend longitudinally about the hemispherical surface 40 of the strainer 38 and are of staggered length so that there are relatively fewer slots which extend to the smaller diameter portion of the hemispherical strainer 38 than which extend to the larger diameter portion of the hemispherical strainer 38. By so staggering the slot apertures 42, a maximum number may be included in the hemispherical surface 40 of the strainer 38 while providing such slot apertures 42 with a uniform width. The bottom apertures 52 in the bottom end 50 have a size substantially equal to the uniform width of the slot apertures 42. The bottom apertures 52 are easily formed in circular configuration and may take other shapes as well, such as similar to the slot apertures 42. Although any suitable dimensions may be utilized, it is found that a dimension of approximately 0.05 inches is appropriate for straining most molten metals.

Use of the strainer 38 may be in the same manner as that described for strainer 12. Specifically, and referring to FIG. 4, the hemispherical strainer 38 may be used in association with the pour cup 14 so that the flange 48 of the strainer 38 abuts against the upper lip 30 of the pour cup 14. The pour cup 14 would be dimensioned such that the chamber 28 between the hemispherical surface 40 of the strainer 38 and the inner surface of the pour cup 14 permits the flow of metal through the outlet port 32. Particulant impurities having dimensions larger than the width of the slot apertures 42 are thus restrained within the strainer 38.

Referring now to FIGS. 9 and 10, in another alternate embodiment of the present invention, a strainer 54 is formed in a generally cylindrical shape. Specifically, the strainer 54 includes a cylindrical surface 56 having a plurality of slot apertures 58, an open top end 60 forming an inlet port 62 and a flange 64 disposed about the perimeter of the top end 60. The bottom end 66 of the strainer 54 also includes a plurality of slot apertures 58.

The slot apertures 58 extend longitudinally about the cylindrical surface 56 of the strainer 54 and laterally about the bottom end 66 thereof. Of course, the bottom end 66 could be formed with apertures similar to the apertures 52 of strainer 38. Again, while any suitable dimensions may be utilized, it is found that a dimension of approximately 0.05 inches is appropriate for straining most molten metals.

Use of the strainer 54 may be in the same manner as that described for the strainers 12 and 38. Again, referring to FIG. 4, the cylindrical strainer 54 may be used in association with the pour cup 14 so that the flange 64 of the strainer 54 abuts against the upper lip 30 of the pour cup 14. The pour cup 14 is dimensioned so that the chamber 28 between the cylindrical surface 56 of the strainer 54 and the inner surface of the pour cup 14 permits the flow of metal through the outlet port 32. Particulant impurities having dimensions larger than the width of the slot apertures 58 are restrained within the strainer 54.

Referring now to FIGS. 11 and 12, alternate shapes for the strainer 54 are shown. Specifically, the strainer 54 could be formed with square surface or triangular surface instead of the cylindrical surface 56. The strainers so formed would still include the flange 64 disposed around the perimeter of the top end thereof, thereby permitting use of either the square or triangular strainer in the same manner as that described for strainer 54. It will be readily appreciated that still other strainer shapes are possible and are contemplated by the present invention.

It should be understood that the embodiments described herein are only illustrative of the present invention, and it should be recognized by those skilled in the art that, for example, the invention may also be practiced with slot apertures running on a bias, or in other configurations. Accordingly, a latitude of modification, change and substitution is intended in the foregoing disclosure. Accordingly, it is appropriate that the appended claims be construed broadly and in a manner consistent with the spirit and scope of the invention.

I claim:

1. A molten metal filter apparatus comprising: a hollow strainer means for selectively restraining particulant impurities in molten metal, said strainer means having a bottom end portion, a longitudinal wall portion and an inlet port; said longitudinal wall portion having a plurality of slot apertures formed therethrough of uniform width to permit passage of the molten metal and prevent passage of particulant impurities, said slot apertures disposed along a substantial longitudinal dimension of said longitudinal wall portion.

2. A molten filter apparatus, as claimed in claim 1, further comprising:

a pour cup means for receiving said strainer means, said pour cup means having an outlet port adapted to mate with an inlet port of a mold.

3. A molten metal filter apparatus, as claimed in claim 1, wherein:

said bottom end portion of said strainer means has a plurality of bottom apertures of a size substantially equal to the width of said slot apertures.

4. A molten metal filter apparatus, as claimed in claim 3, wherein:

said bottom apertures are circular.

5. A molten metal filter apparatus, as claimed in claim 1, wherein:

said longitudinal wall portion extends from a larger diameter section to a smaller diameter section and said slot apertures are of staggered lengths so that there are relatively fewer slots which extend to the smaller diameter section of said longitudinal wall portion than which extend to the larger diameter section of said longitudinal wall portion.

6. A molten metal filter apparatus, as claimed in claim 5, wherein:

said strainer means is frusto-conical in shape.

7. A molten metal filter apparatus, as claimed in claim 5, wherein:

said strainer means is hemispherical in shape.

8. A molten metal filter apparatus, as claimed in claim 1, wherein:

said strainer means is cylindrical in shape.

9. A molten metal filter apparatus, as claimed in claim 1, wherein:

the top of said strainer means has a flange disposed about its perimeter.

10. A molten metal filter apparatus, as claimed in claims 1, 2, 3, 4, 5, 6, 7, 8 or 9 wherein:

said apparatus is made of refractory material.

11. A molten metal filter apparatus, as claimed in claims 1, 2, 3, 4, 5, 6, 7, 8 or 9 wherein:

said apparatus is made of ceramic material.

12. A molten metal filter apparatus, as claimed in claims 1 or 2 wherein: said slot apertures have a width of approximately 0.05 inches.

13. A molten metal filter apparatus comprising: a hollow strainer means for selectively restraining particulant impurities in molten metal, said strainer means formed with an inlet port and a longitudinal wall portion extending from a larger diameter section to a smaller diameter section and having a plurality of slot apertures formed therethrough and disposed longitudinally about said longitudinal wall portion, said slot apertures being of uniform width and of staggered lengths so that there are relatively fewer slots which extend to said smaller diameter section than which extend to said larger diameter section.

14. A molten metal filter apparatus, as claimed in claim 13, wherein:

said strainer means is frusto-conical in shape.

15. A molten metal filter apparatus, as claimed in claim 13, wherein:

said strainer means is hemispherical in shape.

16. A molten metal filter apparatus comprising: a hollow strainer means for selectively restraining particulant impurities in molten metal, said strainer having a longitudinal wall portion, a bottom end portion and an inlet port, said longitudinal wall portion having a plurality of longitudinally disposed slot apertures formed therethrough, said bottom end portion of said strainer means having a plurality of bottom apertures of a size substantially equal to the width of said slot aperatures.

17. A molten metal filter apparatus, as claimed in claim 16, wherein:

said strainer means is frusto-conical in shape.

18. A molten metal filter apparatus, as claimed in claim 16, wherein:

said strainer means is hemispherical in shape.

19. A molten metal filter apparatus, as claimed in claim 16, wherein:

said strainer means is cylindrical in shape.

20. A molten metal filter apparatus comprising: a hollow frusto-conical strainer means for selectively restraining particulant impurities in molten metal, said strainer means having a plurality of slot apertures formed therethrough and disposed longitudinally about its conical surface and an inlet port, said slot aperatures being of uniform width and of staggered lengths so that there are relatively fewer slots which extend to the smaller diameter portion of said strainer means than which extend to the larger diameter portion of said strainer means.

21. A molten metal filter apparatus comprising: a hollow frusto-conical strainer means for selectively restraining particulant impurities in molten metal, said strainer means having a plurality of slot apertures formed therethrough and disposed longitudinally about its conical surface and an inlet port, the bottom of said strainer means having a plurality of bottom apertures of a size substantially equal to the width of said slot apertures.

* * * * *